United States Patent [19]

Giorni

[11] 4,439,884

[45] Apr. 3, 1984

[54] CONTAINER WITH BRISTLES FOR CLEANING INSTRUMENTS

[76] Inventor: Gastone Giorni, Via L. Fatti 23, Sansepolcro/Arezzo, Italy

[21] Appl. No.: 359,602

[22] Filed: Mar. 18, 1982

[30] Foreign Application Priority Data

Apr. 7, 1981 [IT] Italy ..... 1211 A/81
Dec. 21, 1981 [IT] Italy ..... 1229 A/81

[51] Int. Cl.[3] ..... B08B 1/00; A46B 11/00

[52] U.S. Cl. ..... 15/104.92; 15/104.04; 15/160; 211/60 G

[58] Field of Search ..... 15/104.92, 104.04, 160, 15/67, 164, 21 A, 21 B; 211/65, 69, 60 G; 248/524; 433/24, 49

[56] References Cited

U.S. PATENT DOCUMENTS 1,085,249 1/1914 Diven ..... 15/104.92
1,585,939 5/1926 Roepke ..... 15/160
2,121,307 6/1938 Swift ..... 15/104 R
2,404,507 7/1946 Link ..... 15/104.04 X
3,224,029 12/1965 Domingos ..... 15/104.92
3,428,988 2/1969 Blackburn ..... 15/160

FOREIGN PATENT DOCUMENTS 62928 7/1892 Fed. Rep. of Germany ... 15/104.92
1031561 6/1966 United Kingdom ..... 15/104.04

*Primary Examiner*—Peter Feldman
*Attorney, Agent, or Firm*—Collard, Roe & Galgano

[57] ABSTRACT

An open-ended container has a sidewall from the inside of which emerge bunches of bristles converging onto the axis of symmetry or center of the container, which allow instruments with a tool or other element at its tip to be cleaned from residues after use, e.g., dental instruments, and then be disinfected or lubricated. The container also maintains the instrument in an upright position suitable for being handled again, and during the withdrawal phase of the instrument from the container, it repeats the cleaning operation, e.g., the brushing on the bristles, which had previously been done during the insertion of the tool into the container.

12 Claims, 5 Drawing Figures

CONTAINER WITH BRISTLES FOR CLEANING INSTRUMENTS

This invention relates to a container from the inside surface of which project bunches of bristles directed towards its axis of symmetry. More particularly, it relates to such a container for cleaning instruments inserted therein by brushing them against the bristles, as well as for maintaining such instruments in an upright position ready to be easily taken up again and, if necessary, also to disinfect or to lubricate them.

Such a container is particularly useful in the medical and dental field where the instruments, being repeatedly used on the same patient, and afterwards on different patients, need to be cleaned from residues and then be disinfected after every application. Actually, the employed instruments usually consist of elongated handles having tools on one or both ends thereof which, during the therapeutical application, become dirty and require cleaning and disinfecting before and after use. After these cleaning operations, the instruments are often placed, with great instability, on trays not protected from germs or they are put onto hooks where they are often subjected to impacts and/or to being dropped and, if not followed by breakage, have to therefore be cleaned and disinfected once again.

It is therefore an object of the invention to provide a novel container which avoids the above-noted inconveniences and satisfies the need of cleanliness of the tool and, if required, also effects the disinfection of the same without any loss of time, and which also supports the instrument in a handy position, ready to be taken up again.

This object is achieved according to the present invention by the provision of a container from the inside surface of which groups of bristles extend. These bristles merge towards the axis of symmetry of the container and brush against the instruments when they are introduced into the container, removing impurities deposited therein. A suitable liquid, if introduced into the container, provides for disinfection or even lubrication of the tools.

The impurities and dirt will thereby be removed by the bristles and will accumulate on their bases or onto the bottom of the container. The bristles will maintain the thus cleaned, and optionally disinfected, instruments in an upright position.

The container may be realized in many varied forms depending on the environment and on the use it is directed to.

Other objects and features of the present invention will become apparent from the following detailed description considered in connection with the accompanying drawing, which discloses several embodiments of the invention. It is to be understood that the drawing is to be used for the purposes of illustration only, and not as a definition of the limits of the invention.

In the drawing, wherein similar reference characters denote similar elements throughout the several views.

Figure 1:
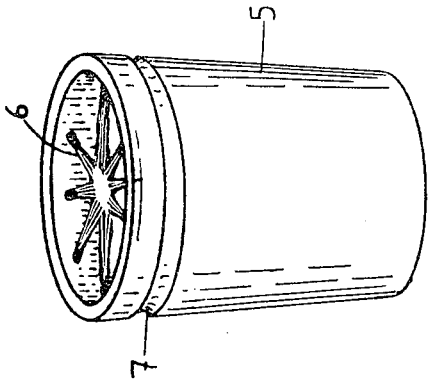
FIG. 1 is a perspective view of a container embodying the present invention.

Referring now in detail to the drawing, and in particular to FIG. 1 thereof, therein illustrated is a cup-shaped container embodying the present invention of circular or polygonal cross section, indicated by reference numeral 5. From the internal surface of the sidewalls of container 5 emerge bunches of bristles 6 directed towards the container's axis of symmetry. The bunches of bristles 6 have a length approximately one-half of the diameter of the container housing. These bristles 6 act upon elongated instruments 8 inserted into the container and onto the tool at the end of the instrument, such as those employed by dentists, thereby removing the deposits accumulating on the tool during use.

Figure 2:
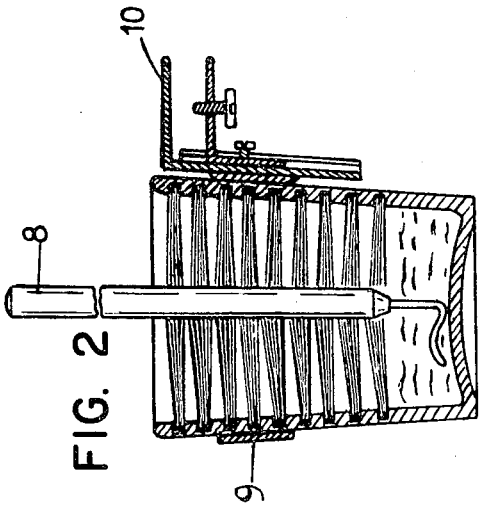
FIG. 2 is a vertical sectional view of a container embodying the present invention, into which a probe is introduced, the container also being shown partially filled with a disinfectant or lubricant liquid and being anchored and supported by a ring and a clamp.

The container 5 is also provided with a circular groove 7 near its top, into which may be applied the elastic wings of a fork (not shown) which supports and positions the container. As shown in FIG. 2, the instrument or probe 8 may be introduced into a disinfectant liquid or lubricant liquid in the bottom of the container, the latter of which may also be supported by a ring 9 connected to a clamp 10 anchoring and supporting it.

Figure 5:
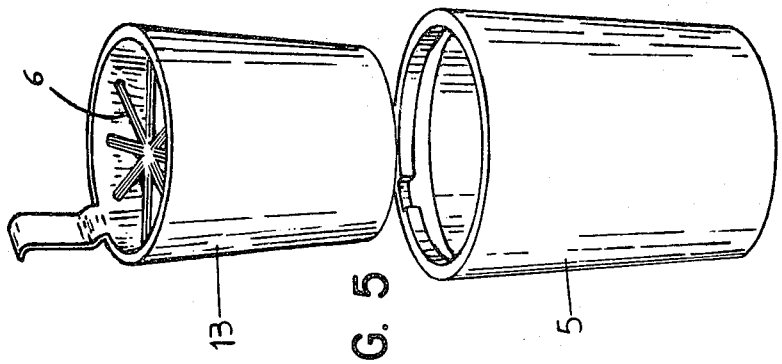
FIG. 5 is an exploded perspective view of another embodiment of the invention.

The bunches of bristles 6, depending on the application, may all be of equal rigidity or be of different rigidity and their length may be such that the extreme ends of the bunches facing each other may touch each other or may cooperatively define an axial cavity which acts as guide for the inserted instruments. In particular, in numerous applications, the employment of longitudinal (i.e., vertically-extending) lines of bristles, natural or artificial ones, alternately long and short, results in a very efficient structure, the first ones being longer and flexible and the second ones being shorter and rigid. As a result of this arrangement, the second ones prevent the inflection of the first ones and push the long flexible ones so that they (1) brush against the tool during the introduction and extraction phase and (2) maintain the inserted instrument in an upright position. In the possible ways of realization, the bunches of bristles 6 may emerge, e.g., from blind holes on the internal sidewalls of the container 5, as per FIGS. 1 and 2, or emerge from a tubular support 13 which will be introduced into the container 5, as per FIG. 5, thereby allowing the replacement of the support 13 or its extraction for periodical cleaning and/or disinfection.

Figure 4:
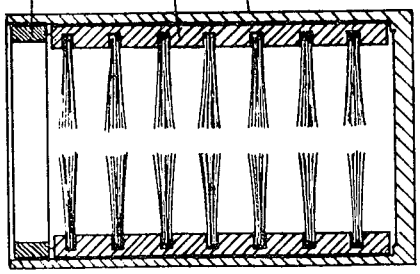
FIG. 4 is a vertical sectional view of the container shown in FIG. 3, additionally showing the provision of a tubular sealing element.
Figure 3:
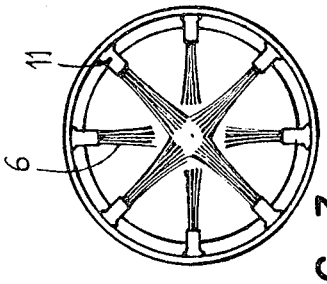
FIG. 3 is a plan view of a different embodiment of the invention.

In the embodiment shown in FIGS. 3 and 4, the container 5 presents internally a plurality of spaced-apart, vertically-extending, longitudinal grooves tapering towards the internal cavity of the container, in which bars 11 from which emerge the bunches of bristles 6 may be slidably inserted; the tapered configuration of the grooves preventing the bars 11 from falling off this fitting.

A tubular sealing ring 12 or an equivalent sealing device, is pressed into the upper part of the container 5, thereby preventing any longitudinal sliding of the bars 11, once they have been inserted.

The container may be placed on a tray or table or be anchored by means of clips, clamps or other known devices, depending on the environment and on its characteristics, where the container will be employed, etc.

While only several embodiments of the present invention have been shown and described, it is obvious that many changes and modifications may be made thereunto without departing from the spirit and scope of the invention.

What is claimed is:

1. A container for cleaning slender instruments comprising:

a container housing having a substantially cylindrically shaped side wall defining an internal chamber; and a plurality of bristle bunches removably mounted in said side wall and radially extending therefrom to converge generally toward the center of said internal chamber of said container housing, said bunches of bristles being longitudinally positioned in said side wall so as to brush against instruments inserted into said container and to maintain said instruments in an upright position, said bunches of bristles having a length approximately one-half of the diameter of the container housing.

2. The container according to claim 1, wherein said bristles are selected from the group consisting of natural bristles, artificial bristles and a combination thereof.

3. The container according to claim 1, wherein said bunches of bristles are of the same length.

4. The container according to claim 1, wherein said bunches of bristles are arranged in longitudinallyextending rows with alternately long and short bunches of bristles.

5. The container according to claim 4, wherein said long and short bunches of bristles have the same degree of rigidity.

6. The container according to claim 4, wherein said short bunches of bristles have a greater degree of rigidity than said long bunches of bristles.

7. The container according to claim 1, wherein at least one of said bunches of bristles have inner ends touching the inner ends of at least one of another bunch of bristles generally near the center of said chamber.

8. The container according to claim 1, wherein certain of said bunches of bristles have inner ends which cooperatively define a longitudinal cavity which acts as guide for introducing instruments into said chamber.

9. The container according to claim 1, wherein said bunches of bristles are mounted in holes in said sidewall and extend generally radially inwardly therefrom.

10. The container according to claim 1 which further includes a tubular support removably mounted within said container housing and having said plurality of bristle bunches mounted thereon to extend radially inwardly toward the center of said internal chamber.

11. The container according to claim 1, wherein said sidewall has a plurality of spaced-apart, longitudinally-extending grooves, and wherein said bunches of bristles are mounted in bars removably received in said grooves.

12. The container according to claim 11, which further includes a removable sealing member mounted in said container above said grooves to prevent displacement of said bars from said grooves.

* * * * *